US009631462B2

(12) United States Patent
Tirado et al.

(10) Patent No.: US 9,631,462 B2
(45) Date of Patent: Apr. 25, 2017

(54) ONE TRIP PERFORATION AND FLOW CONTROL METHOD

(71) Applicant: Baker Hughes Incorporated, Houston, TX (US)

(72) Inventors: Ricardo A. Tirado, Spring, TX (US); Stephen N. Zuklic, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 412 days.

(21) Appl. No.: 13/869,690

(22) Filed: Apr. 24, 2013

(65) Prior Publication Data

US 2014/0318787 A1 Oct. 30, 2014

(51) Int. Cl.

| | |
|---|---|
| ***E21B 43/12*** | (2006.01) |
| ***E21B 34/00*** | (2006.01) |
| ***E21B 43/11*** | (2006.01) |

(52) U.S. Cl.

CPC ..... *E21B 43/12* (2013.01); *E21B 34/00* (2013.01); *E21B 43/11* (2013.01); *E21B 2034/002* (2013.01)

(58) Field of Classification Search

CPC .. E21B 2034/002; E21B 34/00; E21B 43/116; E21B 43/1185; E21B 43/11852; E21B 43/11857; E21B 43/12; E21B 43/263

See application file for complete search history.

(56) References Cited

U.S. PATENT DOCUMENTS

| | | | | |
|---|---|---|---|---|
| 4,690,216 | A * | 9/1987 | Pritchard, Jr. | E21B 43/116 166/165 |
| 5,070,943 | A | 12/1991 | Walker et al. | |
| 5,361,843 | A * | 11/1994 | Shy et al. | 166/297 |
| 7,562,712 | B2 | 7/2009 | Cho et al. | |
| 8,528,649 | B2 | 9/2013 | Kolle | |
| 2003/0164037 | A1* | 9/2003 | Moffatt et al. | 73/152.46 |
| 2004/0099418 | A1* | 5/2004 | Behrmann et al. | 166/312 |
| 2004/0129432 | A1* | 7/2004 | Wills | E21B 33/127 166/387 |
| 2007/0089877 | A1* | 4/2007 | Corre | E21B 33/1277 166/187 |
| 2008/0053658 | A1* | 3/2008 | Wesson et al. | 166/297 |
| 2010/0051278 | A1* | 3/2010 | Mytopher et al. | 166/298 |
| 2011/0011643 | A1* | 1/2011 | Phillips | 175/4.52 |
| 2012/0067582 | A1* | 3/2012 | Fincher | 166/308.1 |
| 2012/0152542 | A1* | 6/2012 | Le | 166/297 |
| 2014/0166277 | A1* | 6/2014 | Ade-Fosudo | E21B 47/06 166/250.17 |

FOREIGN PATENT DOCUMENTS

WO 2013025985 A2 2/2013

* cited by examiner

*Primary Examiner* — Waseem Moorad
*Assistant Examiner* — Christopher Sebesta
(74) *Attorney, Agent, or Firm* — Steve Roseblatt

(57) ABSTRACT

A perforating gun is run in the hole with a valve assembly. Both are remotely actuated with known telemetry techniques. The gun is fired and flow takes place through the gun and is regulated remotely from the surface without further wellbore intervention. The valve assembly can be a sliding sleeve that can be regulated between end positions and in between for flow regulation. Other valve types are contemplated. Signaling can be by acoustic or pressure pulse patterns that work in association with a processor to actuate the gun and the valve assembly in the needed sequence.

20 Claims, 1 Drawing Sheet

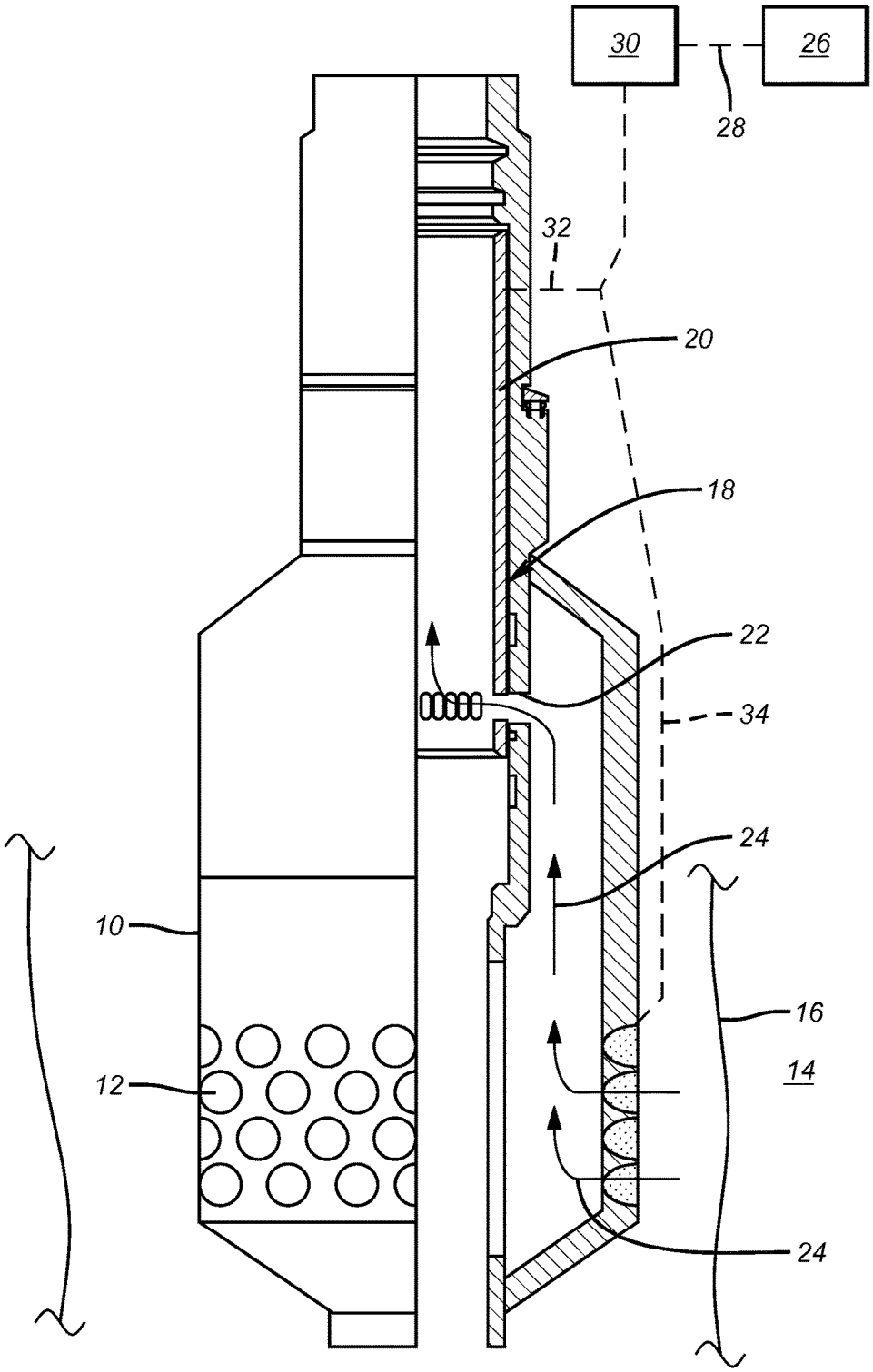
30
26
28
32
20
18
22
34
24
10
16
14
12
24

ONE TRIP PERFORATION AND FLOW CONTROL METHOD

FIELD OF THE INVENTION

The field of the invention is completions and more particularly methods for perforating and well flow control in a single trip.

BACKGROUND OF THE INVENTION

Perforating guns have been adapted for flow into the gun body after being fired as a way to control the local pressure in situations where underbalanced perforating is the goal. The space that held the charges becomes additional volume as a way of local pressure regulation. In some situations discrete flow passages are provided through the gun independently of the location of the shaped charges as in U.S. Pat. No. 5,070,943. In other applications the setting off of the gun opens a non-restricted valve associated with the gun so that production can take place through the gun and subsequent intervention through the gun can take place without reduction in available drift dimension. This design is shown in WO2013/025985 A2.

In some installations the guns are part of a casing string that is properly located and cemented. An inner string with valve assemblies separated by packers is run in and pressure is directed to discrete valves to penetrate the cement and set off discrete guns. The valves are then used in injection service. The valves can be operated through control lines that pass through isolation packers to open or choke for the setting off of the guns or injection. The valves are on an internal string that is run in on a separate trip from the casing that has the guns built into it.

If well flow testing is needed after perforation, the expended gun is typically tripped from the wellbore and a valve assembly is run in the hole and tagged into an existing packer that served to isolate a portion of the wellbore when the gun was suspended below the packer on a running string. The packer, having been set before the gun was fired remains in position as the running string removes the gun and the well test bottom hole assembly is run into the packer for the necessary testing such as drill stem tests.

The present invention saves a trip by delivering the valve or valves that will later be used to flow test or otherwise regulate the well with the gun so that the firing of the gun can be remotely triggered and the regulation of the valve after the gun is fired can also be accomplished by known telemetry techniques or with hydraulic control lines. This allows the completion to progress without a trip in the hole for gun removal and insertion of a BHA to accommodate the valve assembly for subsequent well flow test or shut in procedures. As an alternative a valve that opens on detonation can be used with a tortuous path to control flow. A screen can also be fitted in this alternative design for the flow represented by 24 in the FIG. Using the gun for the flow channel in an axial direction also increases the flow area as compared to use of side mounted guns which add more tortuosity and resistance to flow. These and other aspects of the present invention will be more readily apparent to those skilled in the art from a review of the detailed description of the preferred embodiment and the associated drawing while appreciating that the full scope of the invention is to be found in the appended claims.

SUMMARY OF THE INVENTION

A perforating gun is run in the hole with a valve assembly. Both are remotely actuated with known telemetry techniques. The gun is fired and flow takes place through the gun and is regulated remotely from the surface without further wellbore intervention. The valve assembly can be a sliding sleeve that can be regulated between end positions and in between for flow regulation. The sleeve can be hydraulically operated or electrically operated, for example and can include instrumentation to measure a variety of downhole parameters such as pressure, temperature and flow, for example. Other valve types are contemplated. Signaling can be by acoustic, hydraulic pressure from conduits or from signal wire of adjacent instrument cable or pressure pulse patterns that work in association with a processor to actuate the gun and the valve assembly in the needed sequence.

BRIEF DESCRIPTION OF THE DRAWING

The FIGURE illustrates the gun and the valve assembly schematically and the remote actuation system for them.

DETAILED DESCRIPTION OF THE PREFERRED EMBODIMENT

Referring to the FIGURE there is at least one gun 10 that has a plurality of shaped charges 12 in the desired quantity, strength and array for proper perforation of a desired zone 14 in a borehole 16. Associated with each gun is a valve assembly 18 that can be a sliding sleeve 20 shown in the open position leaving port 22 wide open. The sleeve can also be placed in a variety of positions between fully open and fully closed as well as the end positions. The port 22 can be closed for the firing of the gun 10. Firing the gun can make the charges essentially go away from the mounting locations leaving an array of openings that allow flow if the ports 22 are not in the closed position. Flow from the formation or zone 14 is schematically illustrated as arrows 24. The flow goes through port or ports 22 and to the surface. Those skilled in the art will appreciate that the flow direction can be reversed in an injection well into the formation or zone 14.

Also shown schematically is surface control device 26 that sends a signal 28 to a local processor 30 that connects to the sleeve 20 through an operator schematically shown as dashed line 32 and to the firing head through dashed line 34. The firing head is not shown. The communication options can vary through the use of hydraulic conduits, wire, fiber optic, acoustic, pressure pulses or vibration to name a few.

The present invention offers a way to save a trip in the hole over known systems by letting the flow control equipment be run in with the perforation equipment and combining the ability to sequentially and remotely actuate the gun or guns in a desired order followed by manipulation of the valve or valves in any desired order and into multiple positions representing partly open or fully open for each of the valves that may be deployed. Although one gun and one valve are shown multiples of each are contemplated with selective controls on the timing or setting of each gun or valve respectively. While a single sliding sleeve valve is shown other valve types such as a ball valve or a sleeve that rotates rather than translates are all contemplated for use with the invention.

The above description is illustrative of the preferred embodiment and many modifications may be made by those skilled in the art without departing from the invention whose scope is to be determined from the literal and equivalent scope of the claims below:

We claim:

1. A completion method, comprising:

suspending at least one perforating gun and at least one valve assembly on a running string at to a desired zone in a single trip;

shaping each of said at least one gun to substantially surround said running string in a plane perpendicular to a longitudinal axis of said running string to define an annularly shaped flow path around said running string;

actuating the at least one gun remotely;

operating said at least one valve assembly remotely;

allowing flow between a surface location and the zone through said annularly shaped flow path extending between said running string and said at least one gun and said at least one valve assembly.

2. The method of claim 1, comprising:

said allowing flow further comprises allowing flow through said at least one gun after said actuating.

3. The method of claim 2, comprising:

regulating said at least one valve assembly to throttle flow between an open and a closed position.

4. The method of claim 3, comprising:

providing at least one movable sleeve valve as said at least one valve assembly.

5. The method of claim 4, comprising:

providing a signal generating device at a surface location;

communicating with a processor to process a sent signal and actuate said at least one gun or said at least one valve assembly.

6. The method of claim 4, comprising:

rotating or translating said sleeve between an open and closed position and positions in between.

7. The method of claim 5, comprising:

locating said processor adjacent said at least one valve assembly.

8. The method of claim 7, comprising:

providing at least one of hydraulic conduits, wire, fiber optic, acoustic, pressure pulses or vibration to actuate said at least one valve assembly.

9. The method of claim 8, comprising:

the at least one gun and at least one valve assembly comprise a plurality of guns and valve assemblies delivering the plurality of guns and valve assemblies associated in pairs and selectively operated from a surface location in a predetermined sequence.

10. The method of claim 1, comprising:

regulating said at least one valve assembly to throttle flow between an open and a closed position.

11. The method of claim 1, comprising:

providing at least one movable sleeve valve as said at least one valve assembly.

12. The method of claim 11, comprising:

rotating or translating said sleeve between an open and closed position and positions in between.

13. The method of claim 1, comprising:

providing a signal generating device at a surface location;

communicating with a processor to process a sent signal and actuate said at least one gun or said at least one valve assembly.

14. The method of claim 13, comprising:

locating said processor adjacent said at least one valve assembly.

15. The method of claim 1, comprising:

providing at least one of hydraulic conduits, wire, fiber optic, acoustic, pressure pulses or vibration to actuate said at least one valve assembly.

16. The method of claim 1, comprising:

the at least one gun and at least one valve assembly comprise a plurality of guns and valve assemblies delivering the plurality of guns and valve assemblies associated in pairs and selectively operated from a surface location in a predetermined sequence.

17. The method of claim 1, comprising:

actuating said at least one gun by acoustic, hydraulic pressure from conduits or from a signal wire of adjacent instrument cable or pressure pulse patterns.

18. The method of claim 1, comprising:

using space in said at least one gun opened by firing said at least one gun to conduct flow axially through said at least one gun to the surface.

19. The method of claim 1, comprising:

opening said at least one valve assembly with operating said at least one gun;

providing a tortuous path for flow through said at least one gun for flow control.

20. The method of claim 19, comprising:

screening the flow through said at least one valve assembly.

* * * * *